United States Patent [19]

Staehli

[11] Patent Number: 4,947,522

[45] Date of Patent: Aug. 14, 1990

[54] MOUNTING ARRANGEMENT FOR A STATIONARY FLAT OF A CARDING MACHINE

[75] Inventor: Urs Staehli, Turbenthal, Switzerland

[73] Assignee: Rieter Machine Works Ltd., Winterthur, Switzerland

[21] Appl. No.: 333,456

[22] Filed: Apr. 5, 1989

[30] Foreign Application Priority Data

Apr. 7, 1988 [DE] Fed. Rep. of Germany ..... 3811679

[51] Int. Cl.[5] ..... D01G 15/28

[52] U.S. Cl. ..... 19/104; 19/113

[58] Field of Search ..... 19/104, 110, 113

[56] References Cited

U.S. PATENT DOCUMENTS

| | | | |
|---|---|---|---|
| 2,879,549 | 3/1959 | Miller et al. | 19/104 |
| 3,402,432 | 9/1968 | Kalwaites | 19/104 |
| 4,286,357 | 9/1981 | Harrison, Sr. | 19/104 |

FOREIGN PATENT DOCUMENTS

| | | |
|---|---|---|
| 0195756 | 9/1986 | European Pat. Off. . |
| 1118662 | 11/1961 | Fed. Rep. of Germany . |
| 2547728 | 4/1976 | Fed. Rep. of Germany . |

*Primary Examiner*—Werner H. Schroeder
*Assistant Examiner*—Michael A. Neas
*Attorney, Agent, or Firm*—Werner W. Kleeman

[57] ABSTRACT

The stationary flat of a card or carding machine having mounting flanges arranged at end surfaces of a carding cylinder is mounted at these mounting flanges by means of spring clips. Each spring clip is constructed as a resilient element comprising a radially extending first limb or leg mounted at the associated mounting flange and a second limb or leg which is bent away at an angle with respect to the first limb or leg, partially extends over the associated stationary flat and bears thereupon.

17 Claims, 3 Drawing Sheets

MOUNTING ARRANGEMENT FOR A STATIONARY FLAT OF A CARDING MACHINE

BACKGROUND OF THE INVENTION

The present invention broadly relates to flats of a card or carding machine and, pertains more specifically to a new and improved construction of a mounting arrangement for a stationary flat of a card or a carding machine.

Generally speaking, the new and improved construction of a mounting or attaching arrangement is provided for a stationary flat of a card or carding machine having mounting or attachment flanges at the opposite end faces of the card or carding cylinder. The mounting or attachment flanges serve as supports for respective adjustment or setting blocks at which the ends or end portions of the stationary flat are radially displaceable relative to the axis of rotation of the card or carding cylinder by means of respective adjustment or setting means. Clips or clip members are provided at the ends or end portions of the stationary flat in order to retain or hold such ends or end portions at the associated adjustment or setting block.

A mounting or attaching arrangement of this kind is known from German Patent No. 1,118,662, published Nov. 30, 1961. The specific type of stationary flat described therein is intended as a replacement for the revolving flat. Among other things, this prior art patent teaches the manner in which the stationary flat is to be secured at the card. Various types of mounting or attachment are disclosed therein, each of the rectangular flats being secured at its four corners by respective mounting means which differ in construction and design, probably for adjustment to existing cards.

In one therein disclosed type of mounting arrangement, arcuate fixing members extend around the end faces of the card housing and are referred to as arcuate or curved spring members, although no spring action takes place. The arcuate or curved spring members serve as a kind of mounting flange. However, these arcuate or curved spring members are individually adjustable with respect to the card housing. Each stationary flat is mounted at its two opposed ends which project beyond the end faces of the carding cylinder and are fastened to the arcuate or curved spring members. In another mounting arrangement disclosed therein, holders are provided at the ends of the stationary flat and fit onto adjustment blocks which are supported at the arcuate or curved spring members. An adjusting screw extends through the end of the stationary flat such that the screw base acts upon the adjustment block. By turning this adjusting screw it is possible to adjust the radial distance between the card clothing and the stationary flat.

Once this radial distance has been set, a clamping screw, the base or tip of which bears against a screw thread of the adjusting screw, is tightened to secure the effected adjustment or setting. A peripheral groove is provided in the flat and is located axially beyond the adjusting screw and is engaged by a rigid clip in order to downwardly press the stationary flat. This clip has two limbs or legs. A first limb or leg extends radially and is secured at a radially adjustable arm so as to be rotatable about a pivot. The radial adjustment of the arm is accomplished by means of a screw bolt which bears against the card housing and is secured in the adjusted or set position by means of a nut. The second limb or leg of the clip extends at right angles to the first limb or leg and engages with its free end in the peripheral groove. The free end of the second limb or leg covers the clamping screw such that the latter is only accessible when the clip is disengaged from the flat.

This known mounting arrangement is relatively complicated and requires a corresponding constructional expenditure and the adjusting operation represents a relatively time-consuming operation. It is conceivable that this mounting arrangement can lead to inaccuracy in the adjustment of the stationary flat with respect to the card clothing. For example, the retaining or holding-down force of the clip cannot be set without difficulty, and this also can result in inaccuracy with regard to the spacing between the card clothing and the stationary flat. This adjustment of the stationary flat must either be made with the clip fitted or assembled, the clip then being released, the clamping screw tightened and the clip replaced, or else the adjustment of the flat must be carried out without the clip, an operation which is even less favorable, since the adjustment or setting may change due to the retaining or holding-down force of the clip.

Finally, the known mounting or attaching arrangement, just like other known arrangements in which the stationary flats are rigidly screwed at both ends, results in deformation or warping in the event of thermal expansion, and this occasionally jeopardizes the accuracy of the card clothing spacing between the card or carding cylinder and the stationary flat.

SUMMARY OF THE INVENTION

Therefore with the foregoing in mind it is a primary object of the present invention to provide a new and improved construction of a mounting or attaching arrangement for a stationary flat of a card or carding machine and which does not suffer from the aforementioned drawbacks and shortcomings of the prior art constructions.

Another and more specific object of the present invention aims at providing a mounting or attaching arrangement which is of relatively simple construction and design, rather uncomplicated to adjust or set and ensures positional stability in peripheral and radial directions of the carding cylinder, but yet renders possible that an expansion of the stationary flat is accommodated while also ensuring that the retaining or holding-down force on the stationary flat remains within a predetermined range.

Yet a further significant object of the present invention aims at providing a new and improved mounting or attaching arrangement for a stationary flat of a card or carding machine and which arrangement is extremely economical to manufacture and yet affords highly reliable operation thereof without being subject to breakdown and malfunction, and also requires a minimum of maintenance, servicing and space.

Now in order to implement these and still further objects of the present invention which will become more readily apparent as the description proceeds, the mounting or attaching arrangement of the present invention is manifested, among other things, by the features that each clip or clip member is constructed as a resilient element comprising a first limb or leg extending in radial direction and supported at the associated mounting or attachment flange and a second limb or leg which is bent away from the first limb or leg, partially extends over the stationary flat and bears upon the stationary flat.

Constructing the clip as a resilient element and mounting the first limb or leg of the clip at the mounting or attachment flange, instead of a radially adjustable element, ensures that the retaining or holding-down force of the clip is determined solely by the spring properties of the clip and the predetermined radial range of adjustment of the stationary flat.

In an exemplary embodiment in which the adjustment or setting means each comprises an at least substantially radially extending adjusting or setting screw, the radially inner end or end portion of which bears upon the associated adjustment or setting block, the invention is preferably characterized in that the second limb or leg of each clip extends away from the first limb or leg and over the associated adjusting or setting screw and possesses an opening or aperture which is at least substantially in alignment with the associated adjusting or setting screw. This arrangement renders possible that the second limb or leg can be constructed to be longer than in prior art constructions, such greater length of the second limb or leg being desirable in terms of the spring properties of the clip. The adjusting or setting screw, however, can be operated through the opening or aperture so that the adjustment can be made when the clip is already fitted or mounted and the same retaining or holding-down force prevails during actual adjustment as well as during subsequent operation of the card or carding machine.

Advantageously, each adjustment or setting block is adapted to be clamped at the associated end or end portion of the stationary flat by means of a clamping or locking screw which extends at least substantially parallel to the axis of rotation of the carding cylinder. In the first limb or leg of the clip, there is provided a further or second opening or aperture which is substantially in alignment with the clamping or locking screw.

In this manner, the clamping or locking screw can be operated when the clip or clip member is already mounted or fitted, so that the adjustment or setting can also be secured under operational conditions, i.e. with the clip or clip member mounted. The use of a clamping or locking screw to clamp the adjustment or setting block against the associated end or end portion of the stationary flat is much more elegant and practical than the use of a clamping or locking screw pressing against the adjusting or setting screw. In the latter arrangement the screw-thread of the adjusting or setting screw may be damaged and readjustment of the card-clothing spacing rendered difficult. Furthermore, the damaged adjusting or setting screw may even damage the stationary flat.

Preferably, the adjustment or setting block is guided in a radially extending guide or guide means in the stationary flat and is clampable by the clamping or locking screw against a wall-type boundary or limiting wall surface of the guide or guide means. The guide or guide means contains a recess or chamber formed between an inner wall part and an outer wall part of the stationary flat. The clamping or locking screw extends through a perforation or opening or break-through from the outer wall part bounding or defining the guide recess or chamber and, in the tightened condition, clamps the adjustment or setting block against this outer wall part. A mounting or attaching arrangement of this type has the advantage that the adjustment or setting block can be held captive in the guide or guide means by the clamping or locking screw arrangement before the stationary flat is mounted or fitted. Assembly is thus facilitated.

Both the perforation or opening or break-through and the further or second opening or aperture in the first limb or leg of the clip are preferably formed as slots or elongated holes in order to provide adequate range of adjustment or setting without impairing access to the clamping or locking screw.

In one particularly preferred exemplary embodiment, the first limb or leg of the clip or clip member possesses at its free end an outwardly bent-away part or portion which is adapted to be mounted at the associated mounting or attachment flange by means of a screw or threaded connection. In the simplest mounting arrangement, this outwardly bent-away part or portion of the first limb or leg can be directly mounted at the mounting or attachment flange. In a further mounting arrangement, a mounting or fixing block can be screwed or threadably connected to the mounting or attachment flange, the outwardly bent-away part or portion of the first limb or leg then being adapted to be directly screwed or threadably connected to the mounting or fixing block. In this manner, there is provided a mounting or fixing of the clip at the second limb or leg, such mounting or fixing being easy to accomplish and particularly facilitating assembly of the clip. The spring force is not generated until the outwardly bent-away part or portion of the first limb or leg is screwed to the mounting or attachment flange or to the mounting or fixing block, since the clip is not stretched and tensioned until the fastening or fixing screws are tightened.

In a particularly preferred practical exemplary embodiment, the adjustment or setting block is axially displaceable at a guide or guide means extending substantially parallel to the axis of rotation of the carding cylinder, such guide preferably being provided at the mounting or attachment flange or at the adjustment or setting block. This guide or guide means is subjected to loading only by the predetermined loading of the clip and renders possible that the stationary flat can expand in its longitudinal direction, for example, under thermal stress, without this expansion resulting in deformation or warping of the stationary flat. The clip does not obstruct such expansion, since the free end or end portion of the second limb or leg can move with respect to the stationary flat, and even if this were not the case, an expansion would result in only a slight bending of the first limb or leg of the clip and the forces thus generated would remain within limits that are controllable without difficulty.

The axial guidance of the adjustment or setting block at the mounting or attachment flange or at the mounting or fixing block also ensures that the stationary flat remains substantially in alignment with the axis of rotation of the card or carding cylinder. This is important particularly in arrangements or systems in which a plurality of relatively narrow strip-shaped stationary flats are provided.

Preferably, the clip or clip member or equivalent structure possesses the form or shape of a bent spring-steel strip and the necessary openings or apertures can be stamped or punched out. The use of a bent spring-steel strip renders possible the manufacture of a low-cost spring clip or clip member having exactly predeterminable spring properties or characteristics.

In a particular exemplary embodiment of the invention, the second limb or leg forms with the first limb or leg, in the no-load condition, an angle of less than 90°, preferably an angle in the range from 70° to 85° and, in the assembled or mounted condition, a larger angle of at least substantially 90°. The expected spring force can be determined by presetting this angle.

Preferably, the outwardly bent-away part or portion of the first limb or leg of the spring clip forms with the first limb or leg an angle of substantially 90°, however, advantageously somewhat less, namely 88°.

That end or end portion of the second limb or leg which is remote from the first limb or leg is preferably bent-away in the direction of the axis of rotation of the carding cylinder and this bent-away end or end portion is in contact with the stationary flat. By virtue of this bent-away construction of the second limb or leg, there is ensured that the retaining or holding-down force is applied to the stationary flat from a defined point or location of the spring clip or clip member, so that the magnitude of this force can be accurately determined.

In a card or carding machine, in which the or each stationary flat has a stiffening or bracing rib extending radially outwards and substantially parallel to the axis of rotation of the carding cylinder, the bent-away end or end portion of the second limb or leg is preferably structured to be fork-shaped or bifurcated and can embrace or straddle the stiffening or bracing rib and preferably press against the radially outer side or surface of the stiffening or bracing rib. By virtue of this fork-shaped construction or design of the spring clip, the latter is additionally guided by the stiffening or bracing rib during installation, thus substantially facilitating assembly.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Figure 1:
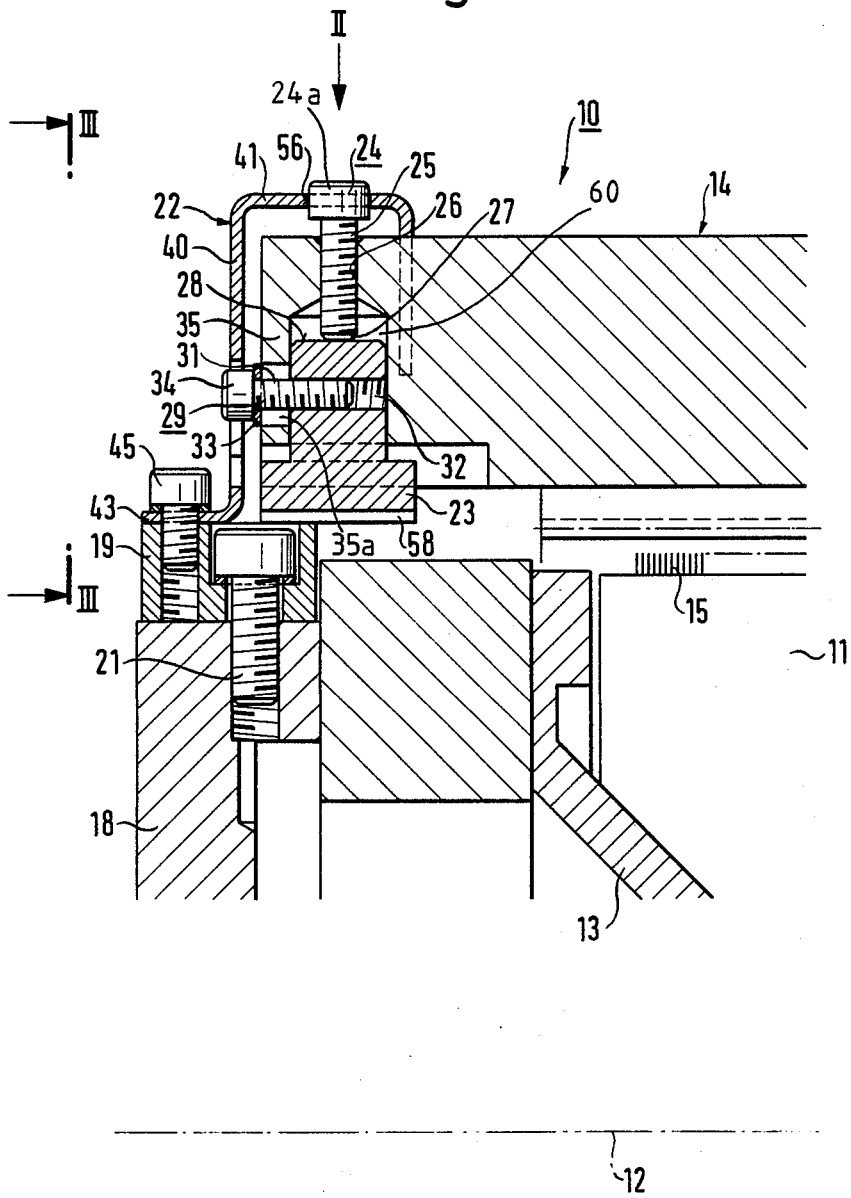
FIG. 1 shows a part of a longitudinal section through a card or carding machine.

Describing now the drawings, it is to be understood that to simplify the showing thereof, only enough of the mounting or attaching arrangement for a stationary flat of a card or carding machine has been illustrated therein as is needed to enable one skilled in the art to readily understand the underlying principles and concepts of this invention. Turning attention now specifically to FIG. 1 of the drawings, a schematically depicted card or carding machine 10 comprises a card or carding cylinder 11, which is drivably mounted to be rotatable about an axis of rotation 12, and a housing 13 which covers the end faces of the card or carding cylinder 11. Only the left-hand part or portion of the housing 13 located at the left-hand end face or surface of the card or carding cylinder 11 is specifically depicted in FIG. 1. The card or carding machine 10 also comprises a number of stationary flats 14, only one of which is visible in the sectional view according to FIG. 1. In addition to the stationary flats 14, the card or carding machine 10 is equipped with a suitable revolving flat which extends over a part or portion of the card periphery, but which is of no specific relevance for understanding the present invention and therefore has not been shown in the drawings.

The card or carding cylinder 11 conventionally carries spiked clothing 15 while the stationary flats 14 carry either saw-toothed clothing or a knife or mote knife at their undersides facing or confronting the spiked clothing 15 of the card or carding cylinder 11. The saw-toothed clothing or knives must be at an accurately adjustable radial distance from the spiked clothing 15 of the card or carding cylinder 11. The stationary flat 14 is of identical construction at the left-hand end and the right-hand end thereof and at these two ends, is adjustably mounted at the card housing 13. This mounting or attaching arrangement will be described hereinafter in greater detail.

As shown in FIG. 1, the card housing 13 comprises a stationarily arranged mounting or attachment flange or flange member 18 which is part of the card housing 13 and annularly extends about the axis of rotation 12 of the card or carding cylinder 11. A mounting or fixing block or block member 19 is mounted at the mounting or attachment flange 18 by means of radially extending screws or threaded bolts 21 or equivalent structure. As shown particularly in FIG. 3, four stationary flats 14 are mounted on the mounting or fixing block 19 and other mounting or fixing blocks or block members 19' and 19'' carrying stationary flats can adjoin to or neighbor the mounting or fixing block 19 in the peripheral or circumferential direction of the card or carding machine 10. Each stationary flat 14 is pressed at the two ends or end portions thereof against the mounting or attachment flange 18 by means of a spring clip or clamp or clip member 22 at each end or end portion.

The support of the two ends or end portions of the stationary flat 14 is accomplished by means of the mounting or fixing block 19 and an adjustment or setting block or block member 23, the top or upper part of which is guided in a radially extending guide or guide means 60 in the associated end or end portion of the stationary flat 14. An adjusting or setting screw or thread bolt 24 having a screw-thread 25 cooperating with a corresponding screw-thread 26 in the associated end or end portion of the stationary flat 14 is located above the adjustment or setting block 23. An end or base or tip 27 of the adjusting or setting screw 24, which end or base or tip 27 is located remote from the actuation head **24*a* of the adjusting or setting screw 24, engages a radially outer surface 28 of the adjustment or setting block 23 and, in this manner, supports the associated end or end portion of the stationary flat 14. The required or desired radial distance from the spiked clothing 15 of the card or carding cylinder 11 can be adjusted or set by appropriately turning or rotating the adjusting or setting screw 24**.

A clamping or locking screw or threaded bolt 29 or equivalent structure extends at right angles to the adjusting or setting screw 24 or the like, i.e. substantially parallel to the axis of rotation 12 of the card or carding cylinder 11, and engages by means of a screw-thread 31 in a corresponding internal thread or tap 32 provided in the adjustment or setting block 23. A washer or disk plate 33 or equivalent structure is located beneath an actuation or operating head 34 of the clamping or locking screw 29 so that, when the latter is tightened, the adjustment or setting block 23 is drawn against an outer wall part 35 of the associated end or end portion of the stationary flat 14 and clamped, thus fixing or securing the distance to which the spiked clothing 15 has been set.

Figure 2:
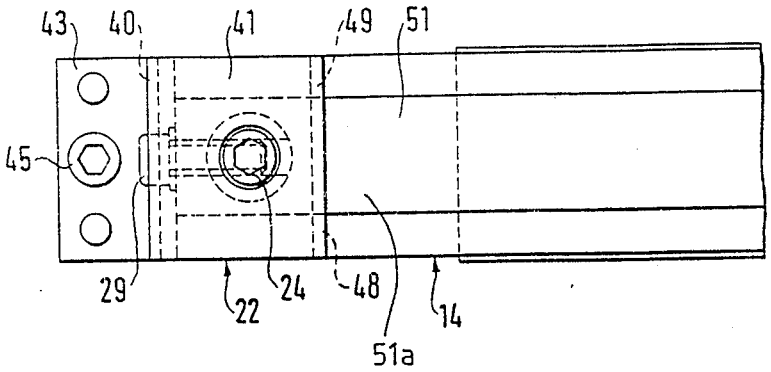
FIG. 2 is a top plan view of the spring clip or clip member illustrated in FIG. 1 looking in the direction of the arrow II in FIG. 1.
Figure 4:
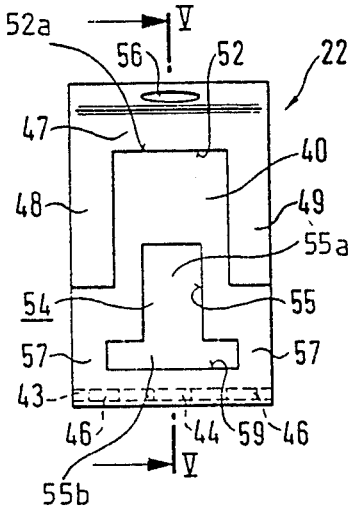
FIG. 4 is a side elevational view of the spring clip or clip member illustrated in FIGS. 1, 2 and 3.
Figure 5:
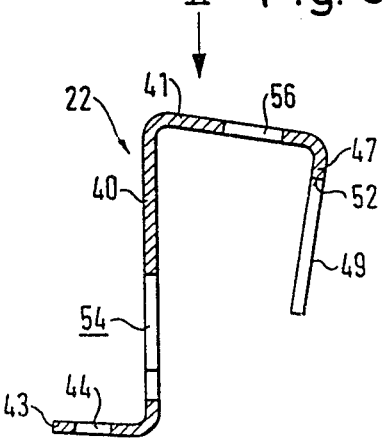
FIG. 5 is a cross-section through the spring clip or clip member in the no-load condition taken substantially along the section line V—V in FIG. 4.
Figure 6:
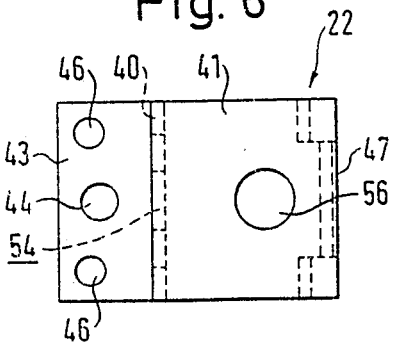
FIG. 6 is a top plan view of the spring clip or clip member of FIGS. 1 through 5 as seen in the direction of the arrow VI in FIG. 5.
Figure 3:
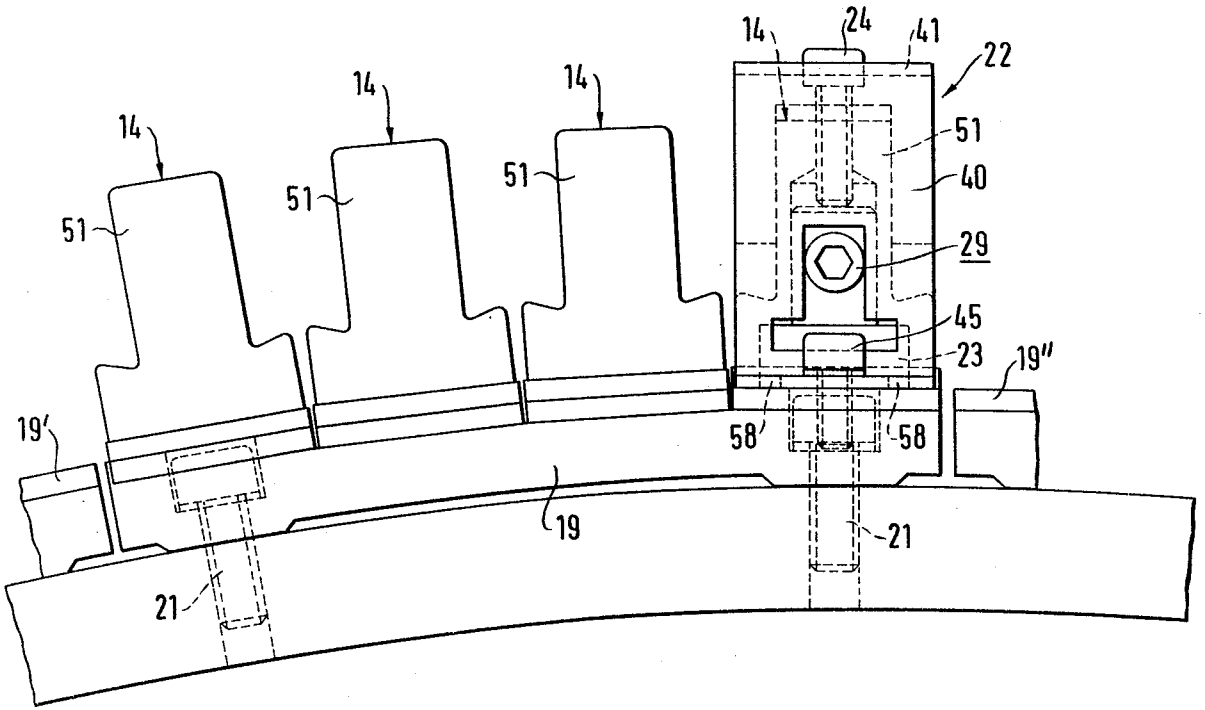
FIG. 3 is an end elevational view looking in the direction of the line III—III of FIG. 1.

The exact form or shape of the spring clip or clip member 22 is particularly depicted in FIGS. 3, 4 and 5. As shown in FIG. 5, the spring clip 22 appropriately bent out of a spring strip comprises a first limb or leg 40 and a second limb or leg 41, the latter here forming with the former an angle of, for instance, about 80°. The first limb or leg 40 possesses an outwardly bent-away part or portion 43 which is provided with a screw hole 44 or the like. By means of this outwardly bent-away part or portion 43, the spring clip 22 can be mounted at the mounting or fixing block 19 by means of a fastening screw or threaded bolt 45 or the like (FIG. 1). The bent-away part or portion 43 of the spring clip 22 possesses two further holes or openings 46 to receive setting or locating pins or the like in order to perfectly define the position of the spring clip 22 at the mounting or fixing block 19. At the end or end portion remote from the first limb or leg 40 the second limb or leg 41 also comprises a bent-away part or portion 47 which possesses a forked or bifurcated configuration. In the assembled position shown in FIG. 1, the two tines or prongs 48 and 49 of the fork-shaped bent-away part or portion 47 extend along both sides of a stiffening or bracing rib or rib member 51 of the stationary flat 14, an edge 52 of the forked opening **52*a* bearing against the top or upper side 51*a* (see FIG. 2) of the stiffening or bracing rib 51 of the stationary flat 14**.

The first limb or leg 40 of the spring clip 22 comprises an inverted substantially T-shaped slot or cutout 54, a perpendicularly extending part or leg 55 of which forms an oblong hole or opening **55*a* through which it is possible to reach the actuation head 34 of the clamping or locking screw 29**.

The screw-thread part 31 of the clamping or locking screw 29 extends through a perforation or opening or break-through **35*a* also formed as a slot at the outer side wall 35 of the associated end or end portion of the stationary flat 14, so that the clamping or locking screw 29 is operative over the entire range of adjustment of the adjusting or setting screw 24. The actuation or operating head 34 of the clamping or locking screw 29 is also accessible through the perpendicularly extending part or leg 55 of the slot 54 over this entire range of adjustment so that the clamping or locking screw 29 can be tightened when the separated spring clip 22 has been assembled. The width of the perpendicularly extending part or leg 55 of the slot 54 is also equal to the diameter of the actuation or operating head 34 of the clamping or locking screw 29**.

In this manner the position of the stationary flat 14 in the peripheral or circumferential direction of the card or carding machine 10 is accurately predetermined by the spring clip or clip member 22 and the clamping or locking screw 29. The spring clip 22 and the clamping or locking screw 29 conjointly form a guide which allows axial expansion of the stationary flat 14.

The cross-member **55*b* of the inverted T-shaped slot 54 forms two narrow regions or zones 57 of the spring or resilient clip 22, such narrow regions or zones 57 defining the flexibility of the spring clip 22 in the axial direction. It should be noted that these zones or regions 57 enable the spring force of the spring clip 22 to be given different magnitudes or values in the axial direction and in the radial direction, so that it is possible to achieve optimum adaptation or accommodation to existing flat mounting conditions. In other words, appropriate selection of the cross-section of the narrow regions or zones 57 enables the axial resistance of the spring clip 22 to be so selected as to be much less than the radial resistance. The axial transmission of the force from the stationary flat 14 to the spring clip 22 is accomplished by means of the actuation head 24*a* of the adjusting or setting screw 24**.

The actuation head **24*a* of the adjusting or setting screw 24 likewise extends through an opening or aperture 56 in the second limb or leg 41 of the spring clip 22 so that this adjusting or setting screw 24 is also accessible and adjustable when the spring clip 22** is already mounted or fitted.

It should be noted that the adjustment or setting block or block member 23 located at each end or end portion of the stationary flat 14 comprises two spaced-apart axially extending guide ribs 58 which are axially displaceable at the associated mounting or fixing block 19.

Having now had the benefit of the foregoing discussion of the exemplary embodiment of the mounting or attaching arrangement for a stationary flat 14 of a card or carding machine, the mode of mounting and assembly of such stationary flat 14 is hereinafter described and is as follows:

In the first place, the mounting or fixing block 19 is screwed to the mounting or attachment flange 18 by means of the radially extending fastening screw or threaded bolt 21. The stationary flat 14 with the adjustment or setting block 23 already fitted or assembled in place is then mounted at the mounting or fixing block 19. The forked bent-away part or portion 47 of the spring clip 22 is then placed over the stiffening or bracing rib 51 of the stationary flat 14 so that the actuation or operating head **24*a* of the adjusting or setting screw 24 projects through or is at least accessible via the opening or aperture 56 in the second leg or limb 41 of the spring clip 22. The fastening screw or threaded bolt 45 is then inserted and tightened. During tightening of the fastening screw 45 the angle between the first limb or leg 40 and the second limb or leg 41 of the spring clip 22 changes from the initial magnitude shown in FIG. 5 to the operational magnitude of, for instance, about 90°, as depicted in FIG. 1. This alone provides the retaining or holding-down force required at the stationary flat 14. The fastening screw 45 or the like, therefore, serves not only to retain or hold the assembled spring clip 22** but also for tensioning the same.

After the fastening screw 45 has been tightened, the adjusting or setting screw or threaded bolt 24 is turned until the required or desired clothing spacing is obtained. The clamping or locking screw 29 is then tightened to secure the position to which the stationary flat 14 has been set with respect to the card or carding cylinder 11. If thermal expansion of the stationary flat 14 occurs during operation, the adjustment or setting block 23 moves in the guide or guide means formed by the spring clip 22 and the clamping or locking screw 29, but the retaining or holding-down force remains essentially constant and the elasticity of the spring clip 22 prevents any forces from being exerted on the stationary flat 14. Such forces could result in deformation or warping of the stationary flat 14. In other words, the longitudinal expansion of the stationary flat 14 is beneficially assisted but the mounting thereof is nevertheless perfectly ensured.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A mounting arrangement for a stationary flat of a carding machine provided with mounting flanges arranged at end faces of a rotatable carding cylinder possessing an axis of rotation, the stationary flat having end portions, comprising:

an adjustment block mounted at each mounting flange which serves as a support;

adjustment means for substantially radial displacement of the end portions of the stationary flat relative to the axis of rotation of the rotatable carding cylinder;

a clip provided at each of said end portions of said stationary flat in order to retain an associated end portion of the stationary flat at an associated adjustment block;

each said clip being defined by a resilient element;

each said clip comprising a first limb extending in substantially radial direction with respect to said axis of rotation of said rotatable carding cylinder and supported at an associated mounting flange and a second limb bent away from said first limb;

each said second limb partially extending over said stationary flat and bearing upon said stationary flat;

each said adjustment means comprising an at least substantially radially extending adjusting screw;

each said adjusting screw having an end portion which is directed to said rotational axis and bears upon an associated adjustment block;

said second limb of each said clip extending from said first limb and over the associated adjusting screw;

each said clip comprising a first opening which is located in said second limb at least substantially in alignment with the associated adjusting screw;

clamping means extending at least substantially parallel to said axis of rotation of the rotatable carding cylinder;

each adjustment block being clampable at the associated end portion of said stationary flat by said clamping means; and each said clip comprising a second opening which is located in said first limb substantially in alignment with said clamping means.

2. The mounting arrangement as defined in claim 1, further including:

guide means provided in said stationary flat and extending in substantially radial direction;

said guide means having boundary wall means; and each said adjustment block being guided in an associated guide means and clamped against said boundary wall means by said clamping means.

3. The mounting arrangement as defined in claim 2, wherein:

said stationary flat comprises an inner wall portion and an outer wall portion;

each said guide means comprising a recess disposed between said inner wall portion and said outer wall portion;

said outer wall portion possessing an opening; and each said clamping means in a clamped position thereof extending through an associated opening of said outer wall portion in order to clamp the associated adjustment block against said outer wall portion which bounds said recess of the associated guide means.

4. The mounting arrangement as defined in claim 3, wherein:

said opening of said outer wall portion and said second opening of said clip define elongated holes.

5. The mounting arrangement as defined in claim 4, further including:

screw connection means;

said first limb of each said clip possessing a free end;

said free end comprising an outwardly bent-away portion; and said outwardly bent-away portion being secured at an associated mounting flange by said screw connection means.

6. The mounting arrangement as defined in claim 4, wherein:

said first limb of each said clip possesses a free end;

said free end comprising an outwardly bent-away portion; and said outwardly bent-away portion being directly secured at an associated mounting flange.

7. The mounting arrangement as defined in claim 5, further including:

a mounting blocking provided for each mounting flange;

further screw connection means;

each said adjustment block being threadably connected with an associated mounting flange by said further screw connection means; and said outwardly bent-away portion being threadably connected to an associated mounting block by said screw connection means.

8. The mounting arrangement as defined in claim 4, wherein:

each said clamping means comprises a clamping screw having a screw-head; and said screw-head and said second opening in an associated clip conjointly forming guide means for axial movement of said stationary flat.

9. The mounting arrangement as defined in claim 8, wherein:

each said clip defined by a resilient element comprises a bent spring-steel strip.

10. The mounting arrangement as defined in claim 9, wherein:

said second limb encloses with said first limb of each said clip in a no-load condition thereof an angle of less than 90° and in an assembled condition thereof a larger angle of at least substantially 90°.

11. The mounting arrangement as defined in claim 9, wherein:

said second limb encloses with said first limb of each said clip in a no-load condition thereof an angle in a range of 70° to 85° and in an assembled condition thereof a larger angle of at least substantially 90°.

12. The mounting arrangement as defined in claim 6, wherein:

said outwardly bent-away portion of said free end of said first limb of each said clip encloses with said first limb an angle of substantially 90°.

13. The mounting arrangement as defined in claim 6, wherein:

said outwardly bent-away portion of said free end of said first limb of each said clip encloses with said first limb an angle of approximately 88°.

14. The mounting arrangement as defined in claim 9, wherein:

said second limb of each said clip possesses an end portion which is remote from said first limb;

said end portion of said second limb being bent away in a direction toward said axis of rotation of the rotatable carding cylinder; and said bent-away end portion of said second limb contacting said stationary flat.

15. The mounting arrangement as defined in claim 14, wherein:

said stationary flat comprises a radially outwardly formed stiffening rib which extends substantially parallel to said axis of rotation of the rotatable carding cylinder;

said stiffening rib having a radial outer side;

said bent-away end portion of said second limb being substantially fork-shaped; and said fork-shaped bent-away end portion of said second limb straddling said stiffening rib and pressing against said radial outer side of said stiffening rib.

16. The mounting arrangement as defined in claim 15, wherein:

said second opening of said first limb of each said clip comprises a slot which possesses the shape of an inverted "T" and defining said elongate hole;

said first limb of each said clip having a predetermined cross-section; and said slot defining said predetermined cross-section of said first limb and thus spring characteristics of said first limb in the direction of said axis of rotation of the rotatable carding cylinder.

17. A mounting arrangement for a stationary flat of a carding machine provided with a mounting flange arranged at an end face of a carding cylinder possessing an axis of rotation, the stationary flat having at least one end portion neighboring said mounting flange, comprising:

an adjustment block arranged at the mounting flange;

adjustment means for substantially radial displacement of the end portion of the stationary flat relative to the axis of rotation of the carding cylinder;

resilient means provided at said end portion of said stationary flat in order to retain said end portion of the stationary flat at the adjustment block;

said resilient means comprising a first limb extending in substantially radial direction with respect to said axis of rotation of said carding cylinder and supported at the mounting flange and a second limb bent away from said first limb;

said second limb partially extending over said stationary flat and bearing upon said stationary flat;

said adjustment means comprising an at least substantially radially extending adjusting screw;

said adjusting screw having an end portion which is directed to said axis of rotation and bears upon said adjustment block;

said second limb of said resilient means extending from said first limb and over the adjusting screw;

said resilient means comprising a first opening which is located in said second limb at least substantially in alignment with the adjusting screw;

clamping means extending at least substantially parallel to said axis of rotation of the rotatable carding cylinder;

said adjustment block being clampable at the end portion of said stationary flat by said clamping means; and said resilient means comprising a second opening which is located in said first limb of said resilient means substantially in alignment with said clamping means.

* * * * *